US005587628A

United States Patent [19]

Kuo

[11] Patent Number: 5,587,628

[45] Date of Patent: Dec. 24, 1996

[54] FIELD EMITTER WITH A TAPERED GATE FOR FLAT PANEL DISPLAY

[76] Inventor: Huei-Pei Kuo, 924 Old Town Ct., Cupertino, Calif. 95014

[21] Appl. No.: 426,357

[22] Filed: Apr. 21, 1995

[51] Int. Cl.[6] ..... G09G 3/00

[52] U.S. Cl. ..... 315/169.3; 315/169.4; 313/351

[58] Field of Search ..... 313/309, 336, 313/351, 495, 496, 497; 315/169.3, 169.4, 56

[56] References Cited

U.S. PATENT DOCUMENTS

| | | | |
|---|---|---|---|
| 3,753,022 | 8/1973 | Fraser, Jr. | 313/80 |
| 5,266,155 | 11/1993 | Gray | 156/651 |
| 5,463,269 | 10/1995 | Zimmerman | 313/309 |

OTHER PUBLICATIONS

Gray, Henry F.; "High Current Density Silicon FEAs", Technical Digestof IVMC 91, Nagahama 1991, pp. 30–31. No Month.

C. A. Spindt, I. Brodie, L. Humphrey, and E. R. Westerberg; "Physical Properties of Thin–film Field Emission Cathodes with Molybdenum Cones", Stanford Research Institute, Jul. 15, 1976.

Nureki, Chizuru and Araragi, Muneki; "Planar Field Emission Devices with Three–Dimensional Gate Structures", Technical Digest of IVMC 91, Nagahama 1991. No Month.

*Primary Examiner*—Robert Pascal
*Assistant Examiner*—David H. Vu

[57] ABSTRACT

A field emission device including a substrate, an emitter layer, a spacer layer and a gate layer. In one preferred embodiment, the emitter layer is made of a resistive material, and has a side end that has an edge. The spacer layer is on and over only a portion of the emitter layer to expose the edge. The gate layer, on the spacer layer, also has a side end that is tapered to form a wedge with an edge. In one application, the device is used in a flat panel display, with a screen. The screen is at a selected positive voltage and is positioned above the gate layer. When a selected potential difference is applied between the emitter layer and the gate layer, an electron-extraction field is established between the edge of the gate layer and the edge of the emitter layer to extract electrons from the edge of the emitter layer. Then, the electrons are attracted to the screen. The wedge reduces the amount of electrons collected at the gate and increases the efficiency of the device. The resistive nature of the emitter layer enhances the uniformity of the electrons emitted along the edge of the emitter layer.

12 Claims, 8 Drawing Sheets

FIELD EMITTER WITH A TAPERED GATE FOR FLAT PANEL DISPLAY

BACKGROUND OF THE INVENTION

The present invention relates generally to field emitters and more particularly to field emitters for a flat panel display.

Numerous researchers have been trying to make reliable field emitters for a flat panel display. It is a very difficult task.

Typically, a field emitter has an emitter that has a sharp tip, with a gate adjacent to the tip. The field emitter is inside a partial vacuum with a fluorescent screen above the gate. The screen is usually at a high positive voltage. When a selected potential difference is applied between the gate and the emitter, electrons are extracted from the tip, and are attracted to the screen by its high positive voltage to generate light on the screen.

One prior art approach generates emitters in the shape of a cone. The tip of each cone is in the middle of its corresponding aperture, with the edge of the aperture in close proximity to the cone. Each aperture serves as the gate of its corresponding cone. Typically, a pixel on a flat panel display is generated by an array of such emitters. A general discussion on such emitters or cathodes can be found in "Physical properties of thin-film field emission cathodes with molybdenum cones," written by C. A. Spindt et al., and published in the Journal of Applied Physics, volume 47, number 12, December 1976.

A typical potential difference between a cone emitter and its corresponding gate is about 100 volts, and the aperture in the shape of a hole has a dimension of about 1 micron. Such a high potential difference not only is a challenge to the corresponding electrical drivers, it also consumes more power than desired, especially if the display is operated by battery. There have been attempts to reduce the potential difference between the gate and its corresponding emitter to less than thirty volts by reducing the dimension of the hole to less than 0.1 micron. Such attempts have not been very successful. Imagine a flat panel display with millions of such emitters across a 10 inches by 10 inches area. It is very difficult and expansive to perform sub-half-micron lithography across such a large surface area.

Also, in the above-described cone and concentric gate field emitter configuration, the electron emission is exponentially proportional to the inverse of the tip diameter, which is one of the more difficult parameters to control in fabricating the field emitter. Due to the extremely sharp nature of the tip, a small change in the tip diameter may produce an unacceptable variation in the emitted electrons, leading to unacceptable non-uniformity in light emission across the display. Such non-uniformity may lead to flickering in electron emission.

Operating voltage on an emitter is proportional to the diameter of the tip of the cone, which can be as small as 100 angstroms, and is typically fabricated using expensive collimated-vacuum-deposition techniques. It is difficult to produce millions of such cones with their tip dimensions substantially the same over the extended area described above. One solution to this non-uniformity is to produce a large number of emitting cones for each pixel. Although one still has to produce the extremely fine tip for each cone, flickering in electron emission is reduced by statistical averaging. Another commonly used scheme to resolve the problem of non-uniformity is to add a current limiting resistor to each cone. The resistor for a cone produces a self-bias that is proportional to the amount of electrons emitted from the cone per unit time—the emission current. The self-bias, in turn, reduces the electric field at the tip of the cone.

In fabricating the millions of field emitters in an array for a flat panel display, the gate and emitter conductors are usually arranged into rows and columns with insulators among them to make them individually addressable. Typically, the insulators among the conductors are left exposed, and are thus bombarded either by electrons emitted from the field emitters, or by electrons back-scattered from the phosphor screen and other positively charged surfaces. Electrons tend to accumulate on the insulator surfaces. This accumulation of the electrons on the exposed insulating surfaces over a prolonged period of time may build potential differences between the insulators and their adjacent conductors to a level higher than those that can be sustained by the insulators. Very often, catastrophic discharges of the accumulated electrons along the surfaces of the insulators will occur, leading to breakdowns of the insulators or destruction of the material locally. This, in turn, will render the device inoperable.

The difficulty in lithography also limits the number of emitters that can be cramped into a single pixel, and limits the effectiveness of the statistical averaging to reduce the flicker in the electron emission. One technique used to increase the density of emission sites, without resorting to even finer and more expensive lithographic techniques, is the use of a line or edge emitter. Line emitter can be envisioned as formed by arranging point emitters with the cones lined up to form a linear array with no space between the tips of the cones. Again, in close proximity to each line is its corresponding gate, which has the structure of a slot, with the line emitter centered in the slot; and the dimension of the slot may be in the sub-micron range. Similar to the cones, the line emitters have a number of difficulties-the sub-micron lithography, the radius of curvature of the edge of each line possibly in the range of 100 angstroms, and many exposed dielectric surfaces to collect reflected electrons. It is difficult to create sharp edges consistently with uniform sharpness along each line to ensure uniform electron emission. If a certain part of an edge is sharper than other parts, electron-emission will be concentrated in that sharp area. Then one will get a dim line of light with a very bright dot. Such an embodiment is not preferred because the possibility of electric breakdown is much higher at that sharp area, and because this reduces the statistical averaging benefit of the line emitter. Moreover, the line emitter is usually separated from its gate by a dielectric layer. The dielectric layer must be thin in order to bring the emitter close to the gate to extract electrons. Any non-uniformity or pinholes in the dielectric layer might lead to dielectric breakdown, which will destroy the device.

Although the line emitter produces a much denser population of emission points or sites, the gain in electron emission may be nullified by a reduction in the electric field at emission sites along the edge of the line. Positioned next to one another, the emission sites shield one another to reduce the electric fields at the emission sites. This reduction in the fields causes the emission from individual site to decrease. To increase the emission current, one could increase the potential difference applied between the gate and the emitter, which would increase the power consumption of the device. Another way to increase the emission current is to reduce the distance between the emitter and the gate, which would increase the field in the dielectric layer separating the gate and the emitter. However, an increase in electric field would increase the chance of dielectric breakdown. The emission current could also be increased by reducing the radius of curvature of the emitters. However, this would add to the difficulty in lithography and thin film processing, further increasing the cost to fabricate the device.

In one implementation, the line emitters are metallic. The conceptual emission sites along such a line emitter are not physically separated from one another. One way to enhance uniform emission is to add individual current limiting resistors to these sites. However, with a metallic emitter, adding such resistors to these conceptual sites is physically impossible. Without the current limiting resistors for the individual sites, the electron emission from the edge would come from sites with smaller radii of curvature. This significantly reduces one of the advantages of line emitters, namely, the high density of emission sites.

One way to alleviate the increased difficulty in processing and lithography is to turn the vertically standing emitter structures into a planar, horizontal, stacked structure. Typically, in such a planar structure, gates are fabricated over and under the emitters to form a gate-emitter-gate stack. Electrons emitted from the horizontal edge or line emitter tend to travel in a horizontal direction. A coplanar anode is used to collect the emitted electrons. These structures may not be suitable for display applications because it is difficult for the remotely located screen of a display to efficiently collect electrons. Some other researchers improved the structure with an additional shielding layer under the lower gate, and a deflector electrode in front of the gate-emitter-gate stack. With appropriate negative voltages on the shield and the deflector, electrons initially in the horizontal direction are deflected to travel in a vertical direction toward the remotely located screen. Such improved structures have a number of defects. First, the deflector and the shield have to be very close to the stacked gate-emitter-gate structure in order to be effective; this requires the use of advanced lithography tools and techniques. Moreover, the voltage on the shield has to be negative enough, and the position of the shield has to be close enough to the emitter to deflect electrons. Such a shield being so close to the emitter is also very close to the gate. This might lead to arcing and dielectric breakdown, which will destroy the device.

It should be apparent from the foregoing that there is still a need for a field emitter that is not too difficult to build, with a high efficiency, capable to form a uniform electron beam across its corresponding pixel, and with a significantly reduced possibility of arcing and dielectric breakdown, which are two of the major causes for the destruction of the thin-film field emitter arrays.

SUMMARY OF THE INVENTION

The present invention provides a reliable field emitter that is relatively easy to build, with a high efficiency, capable to form a uniform electron beam across its emission edge, and with a significantly reduced possibility of arcing and dielectric breakdown.

A first preferred field emitter includes an emitter layer, a spacer layer and a gate layer built on a substrate. The emitter layer, made of a resistive material, has a side end that has an edge. The spacer layer is on and over only a portion of the emitter layer to expose the edge. The gate layer is on the spacer layer, and has a side end tapered to form a wedge with an edge.

The field emitter is positioned such that the gate is below a screen that is at a selected positive voltage. When a selected potential difference is applied between the emitter and the gate, electrons are emitted from the edge of the emitter layer and are attracted to the screen.

The wedge reduces the amount of electrons collected at the gate and increases efficiency of the emitter. The resistive nature of the emitter layer enhances the uniformity of electrons emitted along the edge of the emitter layer. In the preferred embodiment, the shortest distance between the edge of the gate and the edge of the emitter, which is a very critical dimension, is controlled by the thickness of a thin film, the spacer layer. Moreover, the preferred embodiment is fabricated with a self-aligned lithographic process, with the gate functioning as a mask. Thus, one does not require to use sub-micron lithography to manufacture the device.

In another preferred embodiment, the gate layer includes a gate conductive layer over a gate dielectric layer, and the spacer layer is conductive or semiconductive. This embodiment further includes a resistive layer covering at least the portion of the bottom surface of the gate layer that is not covered by the spacer layer. The resistive layer connects the spacer layer to the gate conductive layer. Such a structure reduces the accumulation of electrons on the bottom surface of the gate layer, and reduces the possibility of dielectric breakdown, arcing and leakage current. This embodiment can be further improved by receding the spacer layer over the emitter layer to further expose the edge of the emitter layer. This would reduce the potential difference per unit length in the resistive layer in the portion of the bottom surface of the gate layer that is not covered by the spacer layer, which, in turn, would reduce the chance for dielectric breakdown.

In another preferred embodiment, the gate layer in the first preferred embodiment includes a gate dielectric layer, a gate conductive layer over a portion of the gate dielectric layer, and a resistive layer over at least the portion of the dielectric layer not covered by the gate conductive layer. The resistive layer prevents exposing the gate dielectric layer to the extracted electrons.

The first preferred embodiment can also be improved by having a resistive layer over at least the part of the substrate that is not covered by the emitter layer. This would prevent exposing the substrate to the extracted electrons. The resistive layer can be biased at an electrode on the resistive layer to a selected voltage to further direct the extracted electrons towards the screen. Also, the resistive layer can have a trench, which increases the distance along the resistive layer between the electrode and the edge of the emitter.

Other aspects and advantages of the present invention will become apparent from the following detailed description, which, when taken in conjunction with the accompanying drawings, illustrates by way of example the principles of the invention.

Same numerals in FIGS. 1–6 are assigned to similar elements in all the figures. Embodiments of the invention are discussed below with reference to FIGS. 1–6. However, those skilled in the art will readily appreciate that the detailed description given herein with respect to these figures is for explanatory purposes as the invention extends beyond these limited embodiments.

DETAILED DESCRIPTION OF THE INVENTION

Figure 1A:
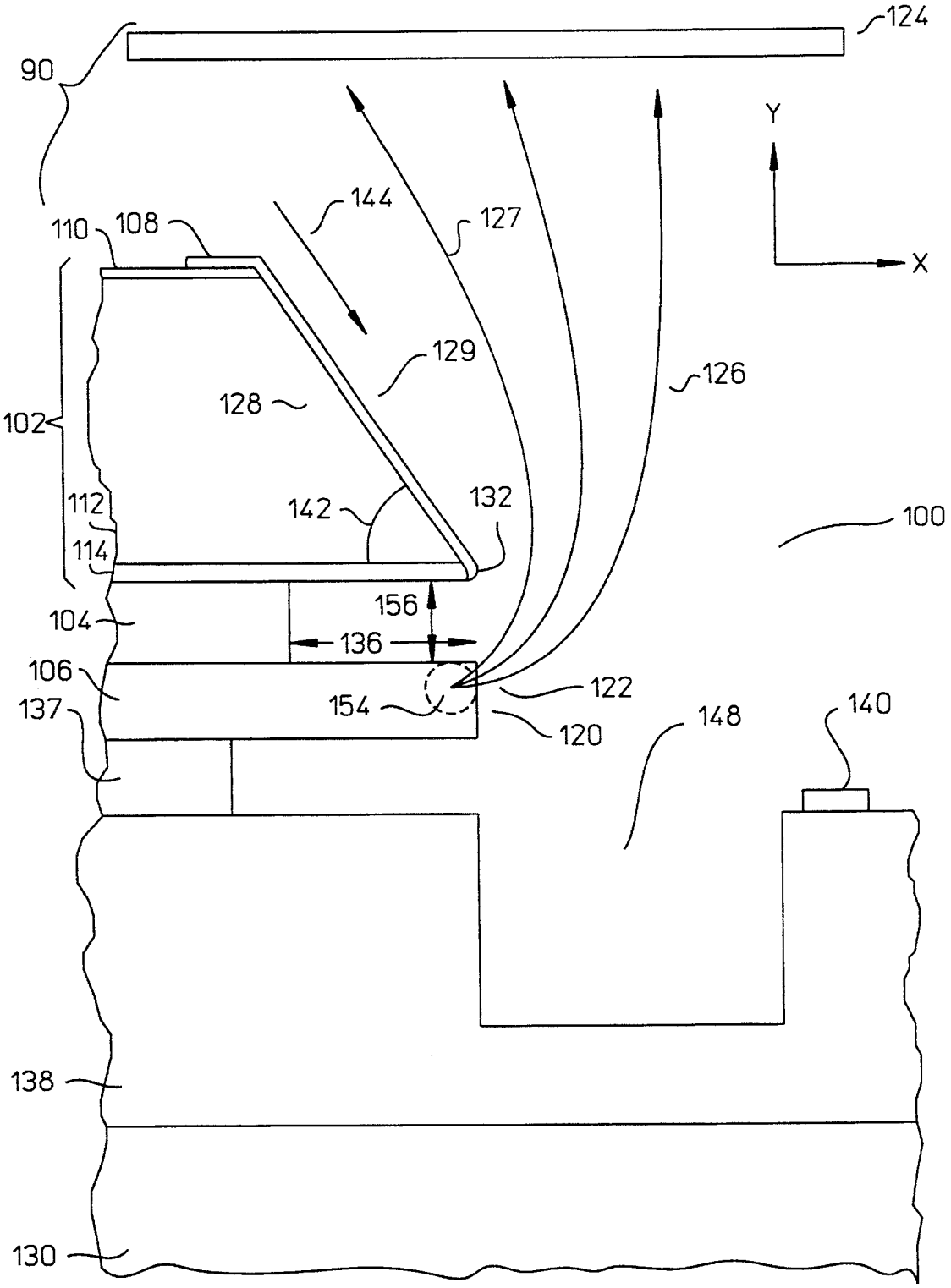
FIGS. 1A–B show two perspectives of a preferred embodiment of the present invention.

FIG. 1A shows a preferred embodiment 100 of the present invention. It is a field-induced electron-emitting device or a field emission device 100. In one application, the device 100 is used in a flat panel display 90 with a screen 124. The device 100, in a partial vacuum, is under the screen 124. The screen 124 may be a fluorescent screen, which emits light when hit by electrons. Typically, a flat panel display has thousands and thousands of such devices, with a minimal of one device per pixel of the display.

The field emission device 100 includes among other layers, a substrate 130, an emitter layer 106 that is made of a resistive material, a spacer layer 104, and a gate layer 102. The emitter layer on top of the substrate has a side end 120 that has an edge 122. In the preferred embodiment, the side end is substantially perpendicular to the substrate 130. However, in other preferred embodiments, the angle between the side end 120 and the substrate can be as much as +/–45 degrees. The spacer layer 104 is over only a portion of the emitter layer 106 to expose the edge 122, and the distance between the end of the spacer layer and the edge 122 is called the spacer distance 136.

The gate layer 102 has a side end 128 that has an edge 132. One preferred embodiment of the device ensures that the shortest line joining the edge 132 of the gate layer 102 and the edge 122 of the emitter layer is substantially perpendicular to the substrate. In such a perpendicular structure, with the thickness of the spacer layer fixed, the distance separating the two edges is the shortest. Note that in other preferred embodiments, the shortest line joining the two edges is not perpendicular to the substrate.

In another preferred embodiment, the entire side end 128 of the gate layer 102 may be coplanar to the side end 120 of the emitter layer 106. However, the performance of the device 100 can be further improved if the side end 128 is tapered, as will be explained below.

The screen 124 is at a selected positive voltage and is positioned above the gate layer 102. When a selected potential difference is applied between the emitter 106 and the gate layer 102, an electron-extraction field is established between the edge of the gate and the edge of the emitter layer. The field extracts electrons 126 from the edge 122 of the emitter layer 106, and the extracted electrons are attracted to the screen 124.

Figure 1B:
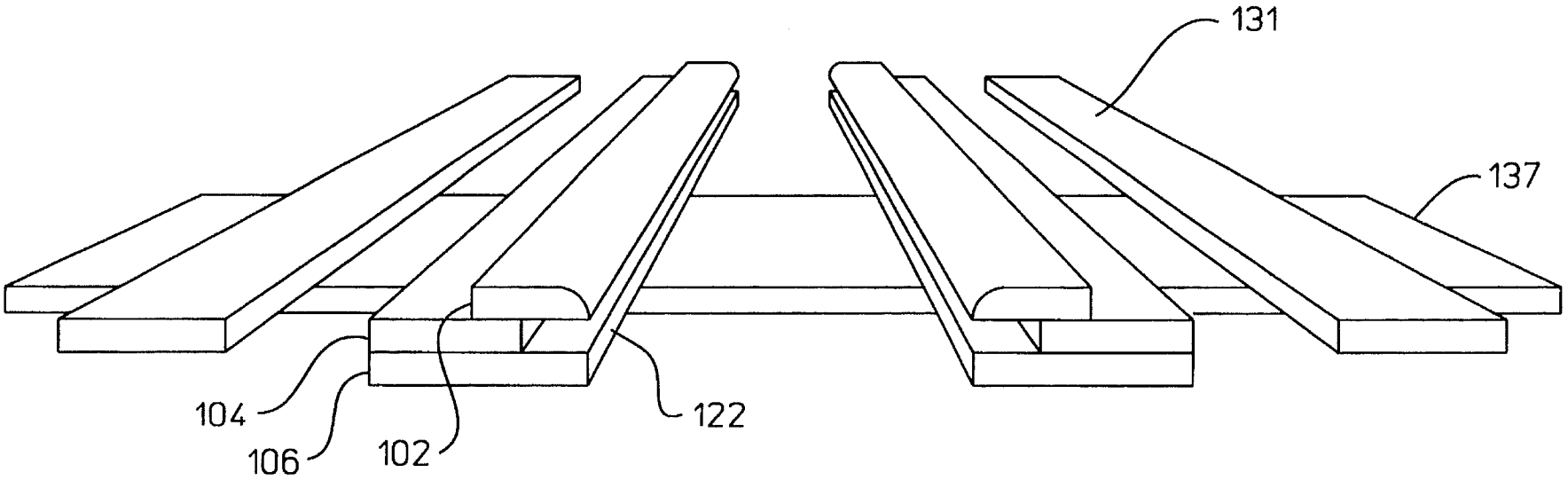

If the preferred embodiment is used in a flat panel display, the gates and the emitters are fabricated to form a matrix of rows and columns of gates and emitters. FIG. 1B shows two of the preferred embodiment 100 arranged side by side, with many layers in FIG. 1A not shown and with a focusing electrode on each side of the two preferred embodiments, such as 131. The focusing electrodes help to focus the emitted electrons towards the screen 124. Typically, a group of contiguous gates and emitters forms a pixel of the display. This multiplicity further reduces the flicker noise in the emission current by statistical averaging, and provides redundancy, making the display more reliable.

In the preferred embodiment, the emitter layer 106 is made of a resistive material, which enhances the uniformity of the electrons emitted along the edge 122 of the emitter layer. The electron emitting edge and the gate can be conceptually divided into small segments with each segment treated as independent electron emission site. A single edge thus provides a large number of emission sites, which, as mentioned above, would provide the needed multiplicity for statistical averaging. Due to variations in the fabrication processes, the diameter 154 of the edge and the spacing 156 between the gate edge 132 and the emitter edge 122 may vary from site to site. Under the same applied voltage between the gate and the emitter, a site with a smaller diameter 154 and/or a shorter spacing 156 emits more electrons than one with larger dimensions. In prior art field emission arrays with metallic emitter edges, the potential on each edge is the same along the edge. This tends to generate a few strong emitting or hot sites on every edge, dominating emission for each edge, and reducing the effectiveness of statistical averaging. However, with a resistive edge, voltage drops of different values can develop at different emission sites along the same edge. These local voltage drops are proportional to the current emitted at the individual emission sites. The applied gate-emitter voltage and the voltage-drop at emission sites are of opposite polarity. The fields experienced by individual emission sites are thus reduced by an amount directly proportional to the emission current. This acts as a negative feedback to reduce the emission from the hot sites, generating a more uniform emission along each edge. In other words, the concept of a single edge as many statistically independent emission sites is realized with a resistive edge.

One preferred resistive material for the emitter layer 106 is silicon carbide. Compared to other types of resistive material, such as silicon, silicon carbide is relatively more chemically inert, and has a much higher breakdown voltage, such as 10 times that of silicon. Also, the resistivity of silicon carbide can be more easily controlled over a wide range, such as from a few ohms-centimeter to the range of resistivities of an insulator.

The side end 128 of the gate layer 102 of the preferred embodiment is tapered to form a wedge 129 with an edge 132 serving as the edge of the gate. The emitted electrons 126 are attracted to the screen 124 because the screen is at a high positive voltage. However, due to the proximity of the gate to the emitter, a portion of the electrons may be collected by the gate 102. The wedge 129 reduces the amount of emitted electrons collected by the gate layer, such as those electrons along the path 127. This will increase the efficiency of the field emission device 100 because electrons attracted to the gate 102 are wasted; they generate heat and do not contribute to the brightness of the pixels on the screen. In one preferred embodiment, the acute angle 142 of the wedge is within the range of 45±25 degrees. This is just a suggested range. A wider range may be used.

Figure 2A:
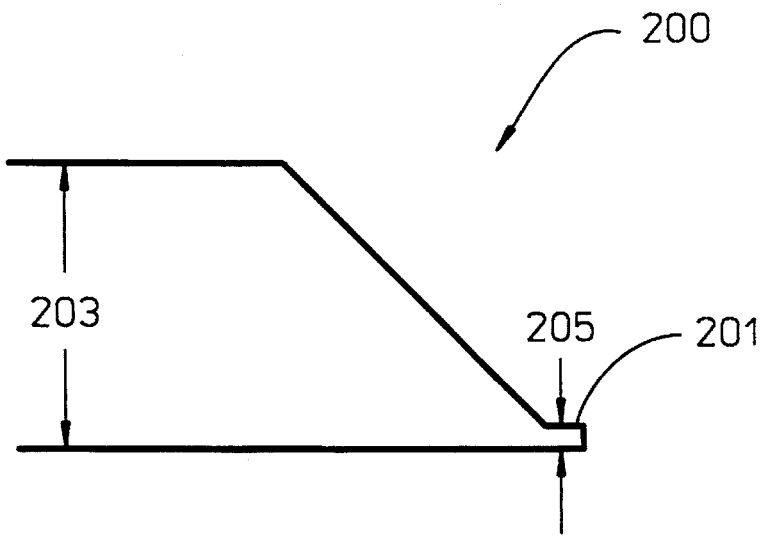
FIG. 2A–B show two preferred embodiments of the wedge in the present invention.
Figure 2B:
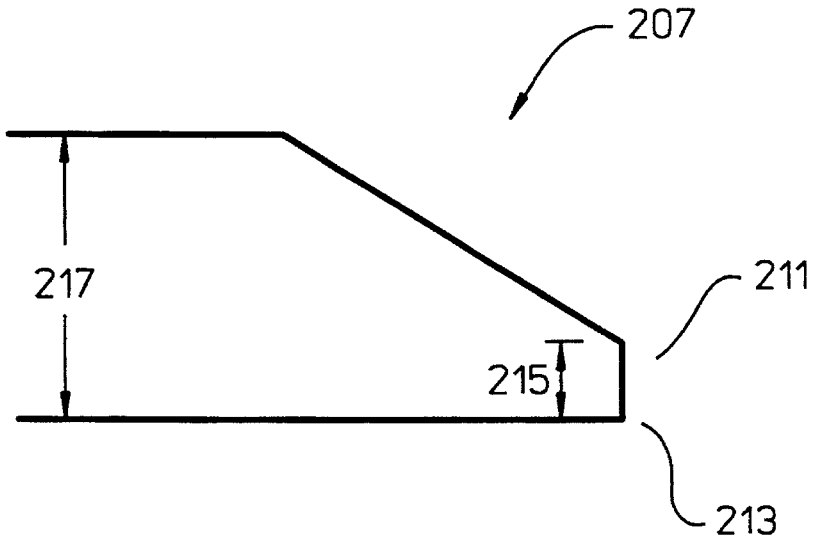

Although the present application discloses a wedge, many substantially similar structures are also applicable if they function in a substantially similar fashion by substantially the same way to achieve substantially the same result. FIGS. 2A–B show two examples of such similar structures. FIG. 2A shows a preferred wedge 200 that has a small lip 201 at its edge. The thickness 203 of the lip 201 is much thinner than the thickness of the wedge 203, for example, the lip thickness is less than 10% of the wedge thickness. FIG. 2B shows another preferred embodiment 207 with a blunt end 211. In such an embodiment, the edge of the wedge is at the corner 213 of the blunt end 211. The height 215 of the blunt end 211 should be substantially less than the height 217 of the wedge in order to reduce the amount of emitted electrons collected by the gate layer. In one preferred embodiment, the height 215 of the blunt end is less than 20% of the height 217 of the wedge 207.

In the preferred embodiment, the gate includes a gate dielectric layer 112 and a gate conductive layer 108, with the spacer layer 104 being semiconductive or conductive. The gate conductive layer 108 carries the voltage of the gate. The dielectric layer 112 ensures that the distance between the gate conductive layer 108 and the emitter layer 106 is increased except for the distance between the edge 132 of the wedge and the edge 122 of the emitter layer 106. This tends to decrease the electric field strength inside the bulk of the dielectric layer, and reduces the possibility of dielectric breakdown.

The preferred embodiment is further improved with a resistive layer 114 covering at least a portion of the bottom surface of the gate; that portion is the part that is not covered by the spacer layer 104, and is the area where the spacer layer 104 has receded from the edge 122. Through the resistive layer 114, the spacer layer 104 is electrically connected to the conductive layer 108 of the gate layer 102.

In many prior art devices, both the gate and the emitter are conductive, and the two are separated by an insulating film. If the electric field in some parts of the insulating film is higher than the field required to breakdown the insulating film, the device may be destroyed.

Figure 3A:
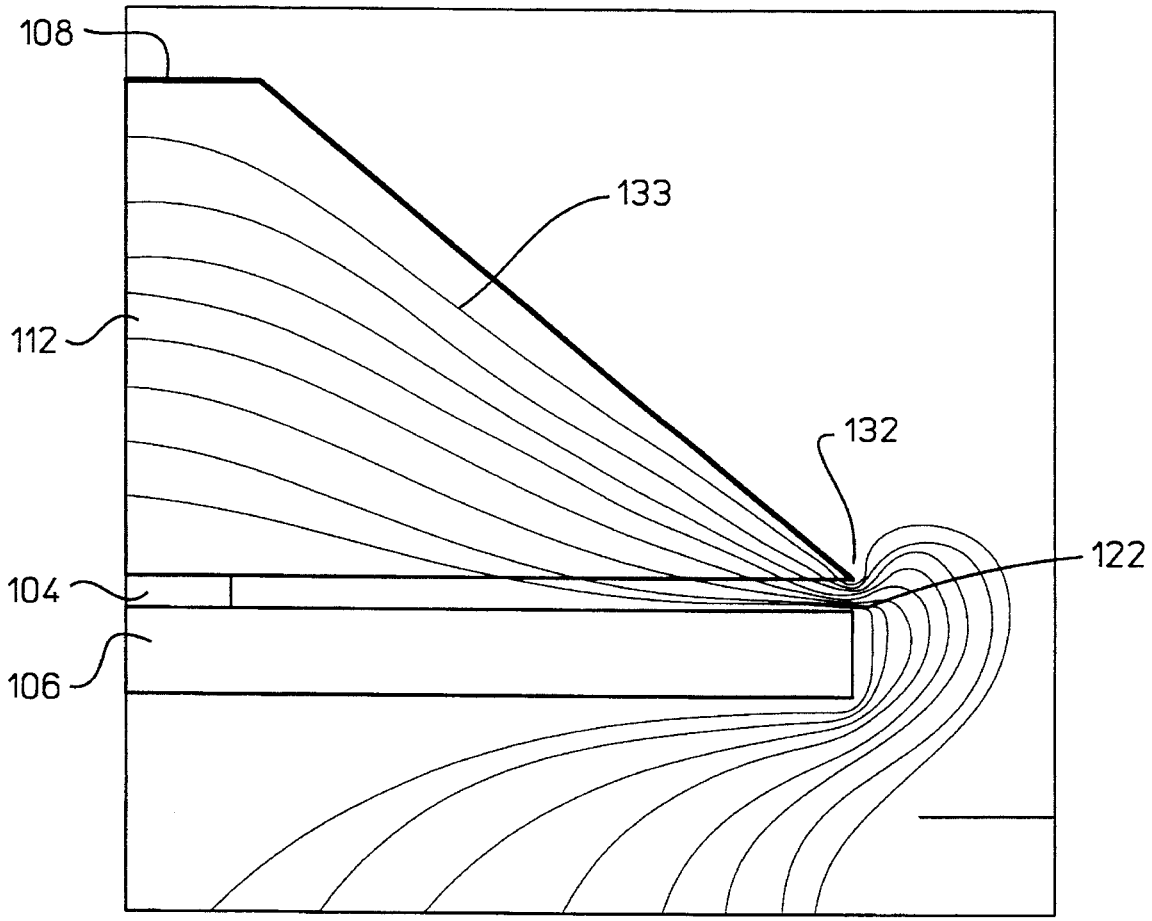
FIGS. 3A–B compare the field distributions with and without one preferred element of the present invention.
Figure 3B:
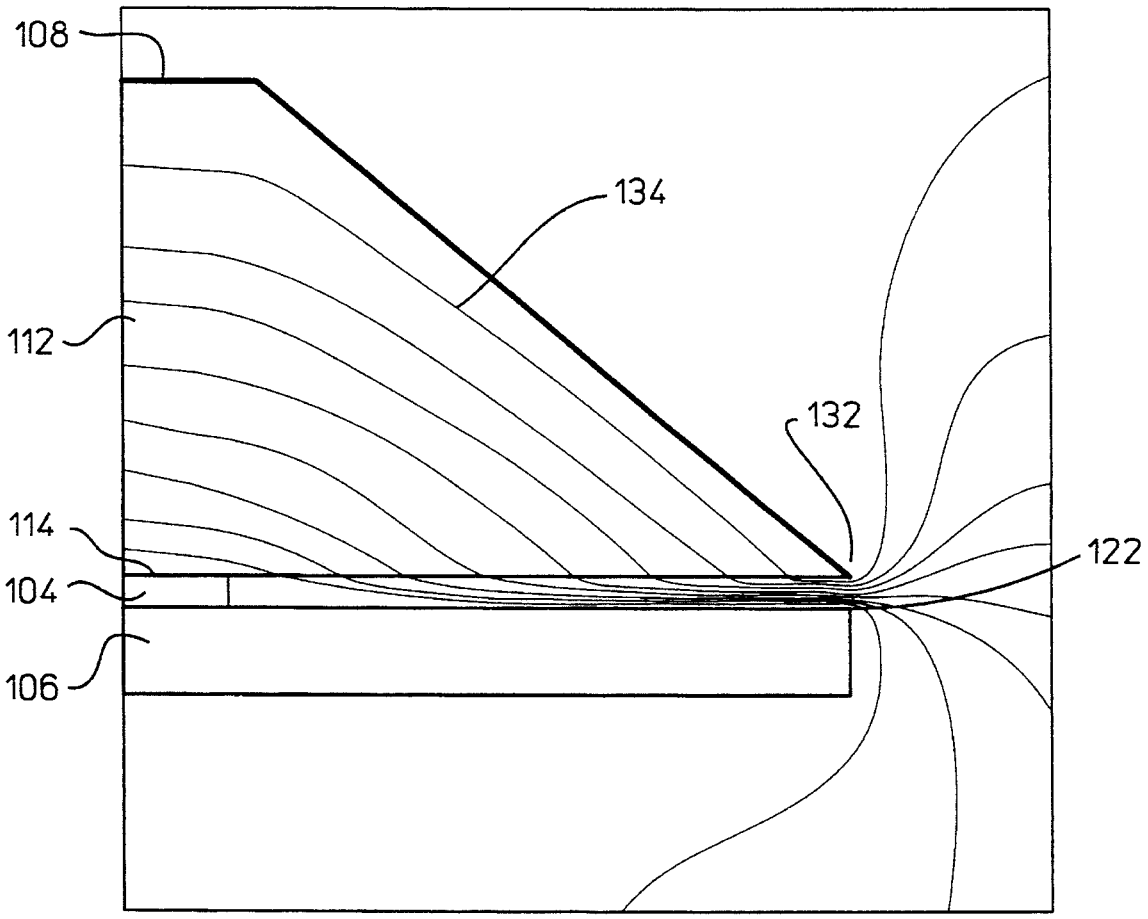

The resistive layer 114 in the present invention reduces the chance of breakdown of the gate dielectric layer. FIGS. 3A–B help to provide an explanation. Many layers are not shown in the figures. FIG. 3A shows a family of equipotential lines when different voltages are applied on the emitter and the gate, without the resistive layer 114; and FIG. 3B shows the family of equipotential lines with the resistive layer 114.

For both FIGS. 3A–B, the same potential difference is applied between the gate conductive layer 108, and the spacer layer 104. In FIG. 3A, the contour lines 133 are highly concentrated in the dielectric region close to the gate edge 132, which means that the field is very high in that region. This increases the chance of dielectric breakdown in the vicinity close to the edge 132.

In FIG. 3B, with the resistive layer 114 in the embodiment, the voltage drops linearly from the spacer layer 104 to the gate conductive layer 108 along the bottom surface of the gate dielectric layer 112. Potential contours 134 in the dielectric layer 112 show the effect of the resistive layer 114. The equipotential contours are not as concentrated as those shown in FIG. 3A, which implies that the electric field strength in the vicinity close to the edge 132 of the dielectric layer is reduced. This, in turn, decreases the chance of dielectric breakdown, especially in the vicinity close to the edge 132.

Another benefits of the resistive layer 114 is that it reduces the chance accumulating emitted electrons on the bottom surface of the gate layer. Note that in the spacer distance 136 area, the emitter layer 106 can have sharp peaks, where electrons may be extracted and attracted to the bottom surface of the gate layer. In addition, some electrons emitted from the emitter edge 122 may also deposit directly onto the bottom surface of the gate layer. If the device does not have a resistive layer 114, the electrons attracted will accumulate on the bottom surface, which might sufficiently charge up the exposed dielectric to a high voltage, leading to dielectric breakdown and/or arcing, and destroying the device. The resistive layer provides a conductive path for the electrons collected to flow away harmlessly.

A further benefit of the resistive layer is that if there is any electrons flowing from the emitter layer 106 to the bottom surface of the gate layer 102, a current will flow on the resistive layer 114, which will lead to a voltage drop along the resistive layer. This voltage drop serves as a feedback to decrease the field experienced by the emitter surface in the spacer distance 136 area, which, in turn, decreases the emission of electrons from the emitter 106 to the bottom surface of the gate layer 102, and reduces the magnitude of leakage current in the field emission device.

FIG. 3A also shows additional advantages of the gate with the dielectric layer 112, even without the resistive layer 114. It should be apparent from FIG. 3A that the electric fields are concentrated between the gate and the emitter edge where a high field is needed to extract electrons from the emitter. However, the field strength inside the gate dielectric layer 112 and in regions far away from the emitter edge is much reduced as compared to the field strength of a device without the dielectric layer 112 because, as mentioned above, the gate dielectric layer 112 increases the separation between the gate conductive layer 108 and the emitter 106. A reduction in field strength leads to a reduction in the capacitance and stored energy between the gate and the emitter. When the device is switched during electron emission, as in the case of a flat panel display, by varying the potential difference between the gate and the emitter, the gate-to-emitter capacitance is charged and discharged alternatively. During the switching interval, stored energy is dissipated mostly as wasted heat. A reduction in capacitance and stored energy lead to less power wasted as heat, and a more efficient device. Thus, a device with reduced field strength requires less power to operate.

The preferred embodiment can also be improved by further receding the spacer layer 104 over the emitter layer 106 to further expose the edge 122 of the emitter layer 106, and to extend the spacer distance 136. With the potential difference between the gate layer 102 and the emitter layer 106 fixed, the potential difference per unit length along the spacer distance 136 is reduced, which in turn reduces the chance of dielectric breakdown of the gate dielectric layer 112.

Another improvement on the preferred embodiment is to include a resistive layer 110 over the gate dielectric layer 112. The resistive layer is over at least the portion of the dielectric layer not covered by the gate conductive layer 108. In a flat panel display environment, there are thousands and thousands of the preferred devices per display, and all the devices should not be coupled to each other. This means that the gate conductive layers of adjacent emitters should be sufficiently electrically isolated. One processing scheme is to etch the gate conducting layer 108 leaving the gate dielectric layer 112 in areas between adjacent field emitters. Such an approach might have one potential problem—a part of the gate dielectric layer may be exposed to the screen. Not all electrons hitting the screen are collected by the screen 124; some of those electrons are reflected. Such electrons, known as stray electrons, and other extracted electrons might deposit on those exposed dielectric areas. The accumulated deposited electrons again might cause dielectric breakdown and arcing. The resistive layer 110 in the present invention is over at least the portion of the gate dielectric layer not covered by the gate conductive layer. Such a resistive layer 110 provides a path for the accumulated deposited electrons to flow away harmlessly. Note that the resistivity of the resistive layer 110 is very high relative to the gate conductive layer 108; thus, the leakage current flowing through the devices connected by the resistive layer 110 is sufficiently low.

Typically, the emitter layer 106 has to be biased by an emitter bus 137. One method is to position the emitter layer 106 directly on top of the emitter bus 137. Different bias schemes are available; they should be obvious to those skilled in the art and will not be further described in the present invention.

The preferred embodiment can also be improved by having a resistive layer 138 over at least the part of the substrate that is not covered by the emitter layer 106. This will prevent exposing the substrate 130 to the stray electrons or other extracted electrons. Again, the accumulation of extracted electrons on the substrate might cause dielectric breakdown and arcing.

Another benefit of having the resistive layer 138 is to apply a selected voltage on an electrode 140 on the resistive layer 138. An electric field will then be created to further direct the extracted electrons towards the screen 124. This will further increase the efficiency of the field emission device 100 because more extracted electrons will go towards the screen 124. In one preferred embodiment, the voltage applied to the electrode 140 is a small positive voltage, which would attract the emitted electrons away from the gate 102. With the voltage on the screen 124 to be significantly more positive, the electrons attracted away from the gate 102 would not go towards the resistive layer 138, but would go towards the screen 124.

The preferred embodiment with the resistive layer 138 and the electrode 140 can be further improved by forming a trench 148 in the resistive layer 138. One advantage of the trench is that it increases the surface path between the electrode 140 where the bias voltage is applied and the edge 122 of the emitter. With the potential difference between the bias voltage and the voltage on the edge 122 fixed, a longer distance between the two locations reduces the potential difference per unit length or the electric field strength along that distance, which, in turn, reduces the chance of dielectric breakdown and arcing along that distance.

Figure 4:
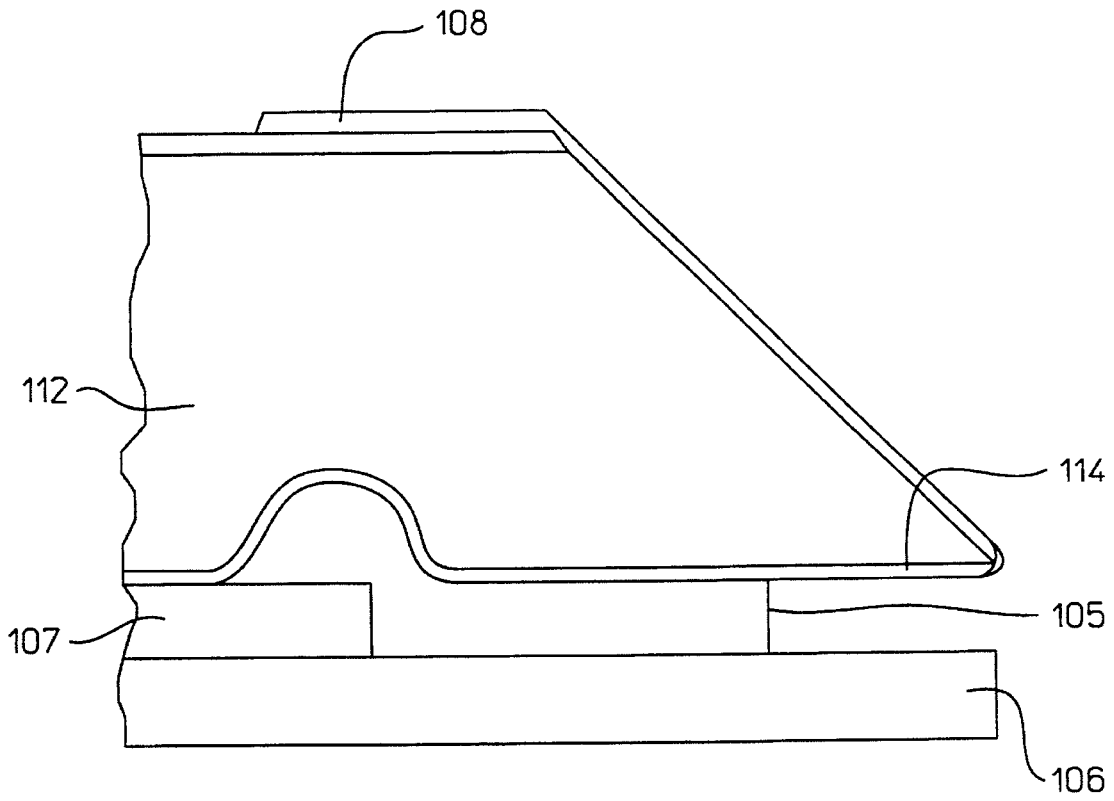
FIG. 4 shows another preferred embodiment of the present invention.

In the above descriptions, the spacer layer 104 is either conductive or semi-conductive. FIG. 4, with many layers omitted for clarity reasons, shows another preferred embodiment with a part 105 of the spacer layer being insulating and another part 107 being conductive. In FIG. 4, the resistive layer 114 on the bottom of the dielectric layer 112 is connected to the emitter layer 106 through a conductive path 107 between the resistive layer 114 at the bottom surface of the gate 102 and the emitter layer 106.

Although the present specification has described different improvements on the basic device with a resistive emitter layer and a gate with a wedge, each improvement can stand on its own to be separately beneficial to a field emission device. Even the gate with the wedge can stand on its own to be beneficial to a field emission device.

WORKING EXAMPLES

The invention will be further clarified by a consideration of the following examples, which are intended to be purely exemplary of using the invention.

The present invention can be fabricated by standard thin-film processes; each individual step should be obvious to those skilled in the art. All the dimensions discussed in the following are of approximate values only.

The fabrication starts with a piece of substrate 130, which can be glass or ceramic or silicon. A one-micron thick silicon is first deposited on the substrate as the resistive layer 138. The resistive layer 138 has a resistivity of about $10^6$ ohm-cm. Then the emitter bus 137 of about 1000 angstroms thick of chromium is deposited, and is patterned accordingly. On top of the emitter bus, a 1000 angstroms thick silicon carbide is deposited as the resistive emitter layer 106. The resistivity of the emitter layer 106 is about $10^4$ ohm-cm. On top of the emitter layer 106, a 1000 angstroms thick chromium is deposited as the spacing layer 104. Then a 100 angstroms thick silicon carbide is deposited as the resistive layer 114 for the bottom surface of the gate layer 102. On top of the 100 angstroms silicon carbide is a 1 micron thick silicon dioxide as the gate dielectric layer 112. This one micron thick oxide layer may be separated into two half-micron thick oxide layer to decrease the chance of pinholes in the oxide layer. Another 100 angstroms thick silicon carbide is deposited on the gate dielectric layer 112 as the resistive layer 110. Over the resistive layer 110, a 5000 angstroms thick tungsten is deposited as a part 108A of the gate conductive layer 108. The resistivity of the two 100 angstroms thick silicon carbide layer is about $10^6$ ohm-cm.

The layers are then processed, as shown in FIGS. 5A–F, where a number of layers are removed for clarity reasons. Not all steps are shown. Many steps are omitted; the omitted steps should be obvious to those skilled in the art.

Figure 5A:
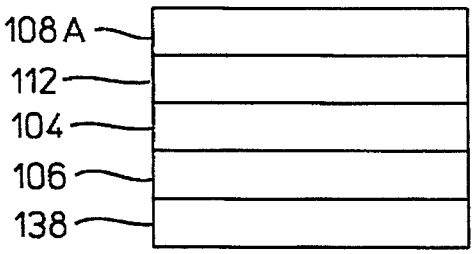
FIGS. 5A–F show processing steps to fabricate one preferred embodiment of the present invention.
Figure 5D:
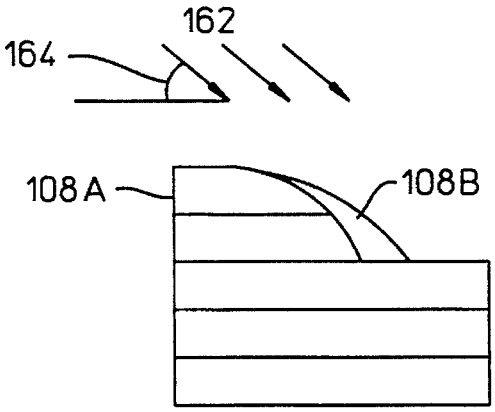
Figure 5B:
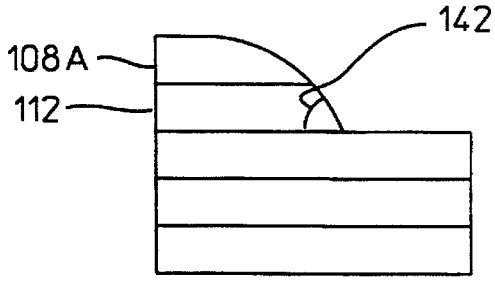
Figure 5E:
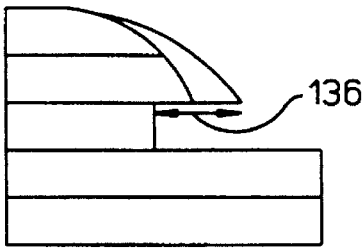
Figure 5C:
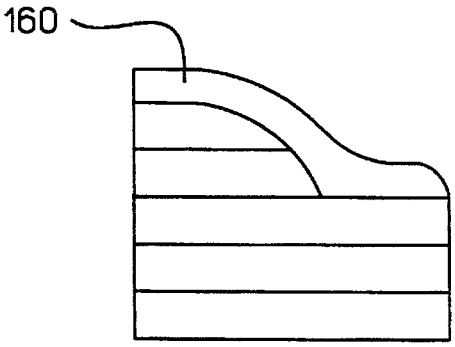
Figure 5F:
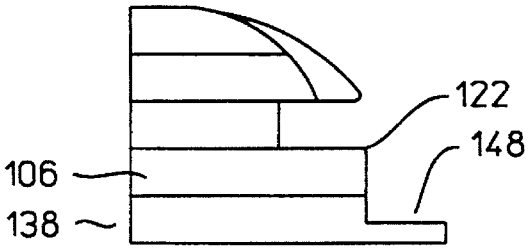

FIG. 5B shows the result of the gate dielectric layer 112 and the gate conductive layer 108A being patterned to form the wedge. The acute angle 142 of the wedge is preferably about 45 degrees. A 1000 angstrom thick chromium layer 160 is deposited on top of the wedge, as shown in FIG. 5C. Then the chromium layer 160 is ion-milled 162 at an angle. Preferably, the ion-milling angle 164 is substantially the same as the acute angle 142 of the wedge. With ion-milling performed at an angle, a layer 108B of chromium is left on the side end 128 of the gate layer 102, when all the other chromium is removed, as shown in FIG. 5D. The chromium layer 108B on the side end together with the tungsten layer 108A on top form the gate conductive layer 108. The chromium spacing layer 104 is then undercut by wet etch. The spacing distance 136 is about 1 micron. The result is shown in FIG. 5E. FIG. 5F shows the emitter layer 106 and the resistive layer 138 being etched through to form the emitter edge 122, and a part of the trench 148. Thus, the emitter edge 122 is fabricated by a self-aligned lithographic process with the gate functioning as a mask.

In the above example, the electric field strength with the resistive layer 114 can be as many as ten times lower than the field strength without the resistive layer 114 in the vicinity close to the edge of the gate.

Figure 6:
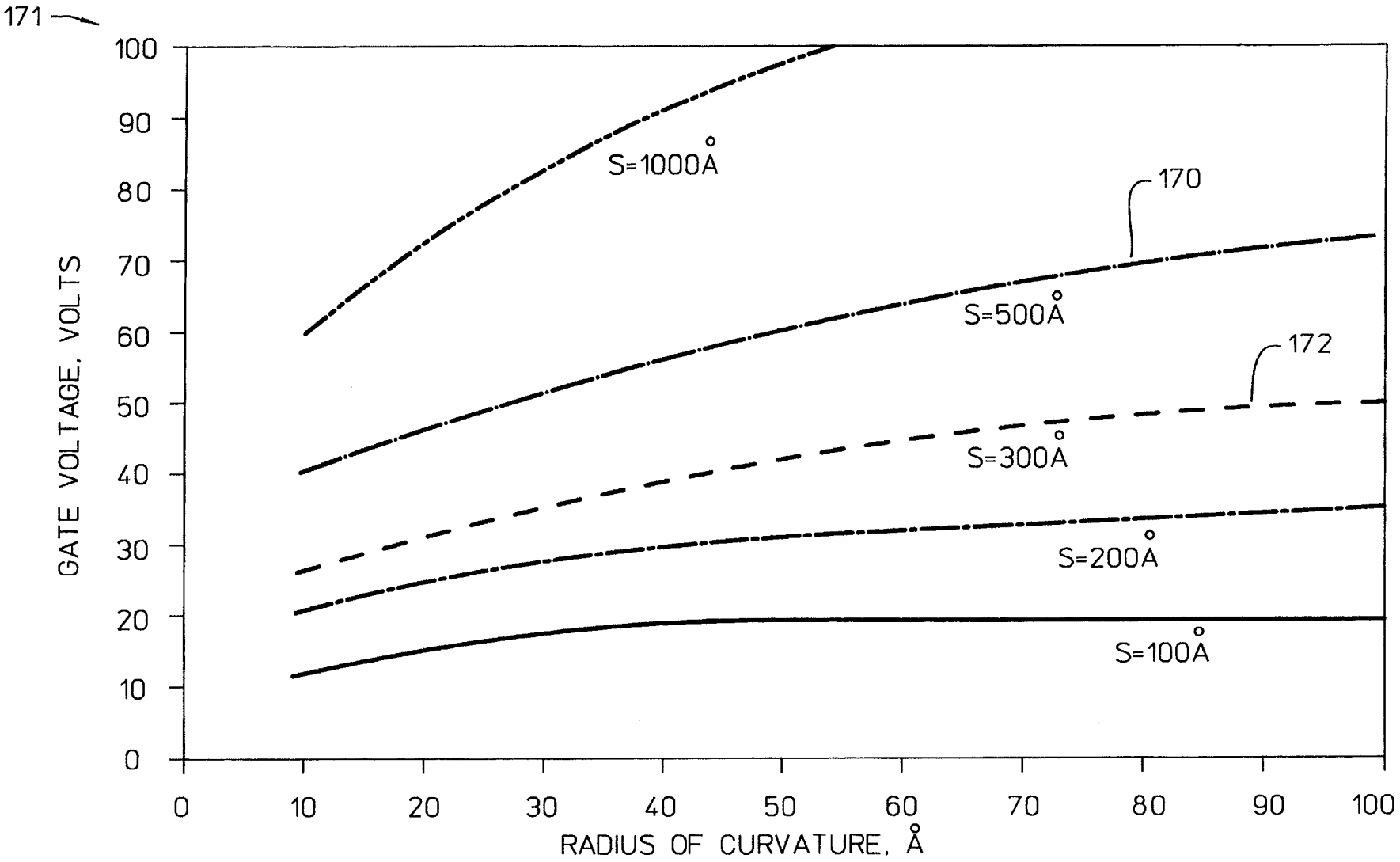
FIG. 6 shows the gate voltage vs the diameter of the edge of the emitter layer of a preferred embodiment of the present invention.

Another additional benefits of the present invention is that the performance characteristics of the device is relatively insensitive to variations in the radius of curvature 154 of the edge 122 of the emitter layer 106. FIG. 6 is a graph 171 showing a theoretical calculation of the operating gate voltage as a function of the radius of curvature 154 of the working embodiment. The operating gate voltage is defined as the voltage required to generate an emission current density of 100 amps/cm$^2$ for a material with a work function of 3.5 eV. Operating curves, such as 170 and 172, are for several S or gate-emitter spacing 156, in Å. The curves indicate that the operating voltage is relatively insensitive to the variation in the radius of curvature, which is considered to be one of the more difficult parameters to control in thin-film processes to make field emitters. The voltage, however, varies substantially linearly as a function of the gate-emitter spacing 156, which is controlled by the thickness of the spacing layer 104. Such a thickness is relatively easy to control in thin-film processes.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

I claim:

1. A field emission device in an apparatus with a screen, the device comprising:

a substrate;

an emitter layer, made of resistive material, coupled to the substrate, the layer having a side end that has an edge, a spacer layer on and over only a portion of the emitter layer to expose the edge; and a gate layer, on the spacer layer, the gate layer having a side end that is tapered to form a wedge with an edge, and including:

a gate dielectric layer; and a gate conductive layer over the gate dielectric layer to cover at least the side end and the edge of the gate layer;

wherein the screen is at a selected positive voltage and is positioned above the gate layer; such that:

when a selected potential difference is applied between the edge emitter and the gate layer, an electron-extraction field is established between the edge of the wedge and the edge of the emitter layer to extract electrons from the edge of the emitter layer, and the electrons are attracted to the screen;

the resistive nature of the emitter layer enhances the uniformity of the electrons emitted along the edge of the emitter layer; and the wedge reduces the amount of extracted electrons collected by the gate layer.

2. A field emitter device as recited in claim 1 wherein the shortest line joining the edge of the emitter layer and the edge of the wedge is substantially perpendicular to the substrate.

3. A field emitter as recited in claim 1 wherein the resistive material is silicon carbide.

4. A field emission device as recited in claim 1 further comprising:

a resistive layer covering at least the portion of the bottom surface of the gate layer that is not covered by the spacer layer;

wherein:

and a gate conductive layer; and the spacer layer is made of a material selected from the group of conductor and semiconductor;

such that:

the resistive layer electrically connects the spacer layer to the conductive layer of the gate layer, reducing the chance of breakdown of the gate dielectric layer and reducing the chance of the accumulation of extracted electrons deposited on the bottom surface of the gate layer.

5. A field emission device as recited in claim 4 wherein the spacer layer is further receded over the emitter layer to further expose the edge of the emitter layer and to reduce the potential difference per unit length in the resistive layer in the portion of the bottom surface of the gate layer that is not covered by the spacer layer.

6. A field emission device as recited in claim 1 further comprising:

a resistive layer covering at least the portion of the bottom surface of the gate layer that is not covered by the spacer layer; and a conductive path connecting the resistive layer and the emitter layer;

wherein a gate conductive layer; and the spacer layer includes an insulating layer;

such that the resistive layer electrically connects the emitter layer to the conductive layer of the gate layer to reduce the chance of breakdown of the gate dielectric layer and to reduce the chance of the accumulation of extracted electrons deposited on the bottom surface of the gate layer.

7. A field emission device as recited in claim 1 wherein the spacer layer is further receded over the emitter layer to further expose the edge of the emitter layer to reduce the potential difference per unit length between the spacer layer and the side end of the gate layer.

8. A field emission device as recited in claim 1 wherein the gate layer includes:

a gate conductive layer over a portion of the gate dielectric layer; and a resistive layer over at least the portion of the dielectric layer not covered by the gate conductive layer;

such that the resistive layer prevents exposing the gate dielectric layer to the extracted electrons.

9. A field emission device as recited in claim 1 further comprising a resistive layer over at least the part of the substrate that is not covered by the emitter layer so as to prevent exposing the substrate to the extracted electrons.

10. A field emission device as recited in claim 9 wherein the resistive layer is biased at an electrode on the resistive layer to a selected voltage to further direct the extracted electrons towards the screen.

11. A field emission device as recited in claim 10 wherein the resistive layer has a trench, which increases the distance along the resistive layer between the electrode and the edge of the emitter.

12. A field emission device as recited in claim 1 further comprising:

a resistive layer over at least the portion of the dielectric layer not covered by the gate conductive layer;

such that:

the resistive layer prevents exposing the gate dielectric layer to the extracted electrons.

* * * * *